US008854409B2

(12) United States Patent
Chun et al.

(10) Patent No.: US 8,854,409 B2
(45) Date of Patent: Oct. 7, 2014

(54) IMAGE FORMING APPARATUS HAVING VARIABLE DEVELOPER INTERVALS

(71) Applicant: Samsung Electronics Co., Ltd, Suwon-si (KR)

(72) Inventors: Jin-kwon Chun, Suwon-si (KR); Ho-hyun Hwang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/669,956

(22) Filed: Nov. 6, 2012

(65) Prior Publication Data

US 2013/0064576 A1 Mar. 14, 2013

Related U.S. Application Data

(62) Division of application No. 12/654,630, filed on Dec. 28, 2009, now Pat. No. 8,330,784.

(30) Foreign Application Priority Data

Aug. 25, 2009 (KR) ..... 10-2009-0078850

(51) Int. Cl.

| | |
|---|---|
| ***B41J 15/14*** | (2006.01) |
| ***B41J 27/00*** | (2006.01) |
| ***G03G 15/01*** | (2006.01) |
| ***G03G 15/04*** | (2006.01) |

(52) U.S. Cl.

CPC ..... *G03G 15/0409* (2013.01); *G03G 15/011* (2013.01)

USPC ..... 347/243; 347/261

(58) Field of Classification Search

USPC ..... 347/228, 229, 232–234, 243, 248, 347/259–261

See application file for complete search history.

(56) References Cited

U.S. PATENT DOCUMENTS 6,466,246 B2 10/2002 Fujimoto
6,539,194 B2 * 3/2003 Oikawa ..... 399/299

(Continued)

FOREIGN PATENT DOCUMENTS

JP 10186254 A * 7/1998 ..... G02B 26/10
KR 10-2007-0035093 3/2007

OTHER PUBLICATIONS

U.S. Office Action mailed Mar. 29, 2012 of copending U.S. Appl. No. 12/654,630.

(Continued)

*Primary Examiner* — Hai C Pham
(74) *Attorney, Agent, or Firm* — Staas & Halsey LLP

(57) ABSTRACT

An image forming apparatus including a plurality of developers and optical scanners, each of the optical scanners having a light source and a light reflecting unit and forming an electrostatic latent image on a photo conductor of each of the developers. The optical scanners have the same focusing distance from the light source to the photo conductor. The light reflecting unit of one of the optical scanners is arranged at a position different from the light reflecting unit of another optical scanner, such that intervals between the developers vary. The plurality of developers include a yellow (Y) developer, a magenta (M) developer, a cyan (C) developer, and a black (K) developer. The optical scanners include a first optical scanner, which forms electrostatic latent images on two of the developers including the black (K) developer, and a second optical scanner, which forms electrostatic latent images on the other two developers.

2 Claims, 4 Drawing Sheets

(56) References Cited

U.S. PATENT DOCUMENTS

| | | | | |
|---|---|---|---|---|
| 6,823,158 | B2 * | 11/2004 | Yamada et al. | 399/179 |
| 6,906,739 | B2 * | 6/2005 | Suzuki et al. | 347/233 |
| 6,938,351 | B2 * | 9/2005 | Kobayashi et al. | 33/299 |
| 7,230,638 | B2 | 6/2007 | Fukutomi | |
| 7,522,326 | B1 | 4/2009 | Otoguro | |
| 8,330,784 | B2 * | 12/2012 | Chun et al. | 347/243 |
| 2003/0112486 | A1 | 6/2003 | Kudo | |

OTHER PUBLICATIONS

U.S. Notice of Allowance mailed Aug. 13, 2012 of copending U.S. Appl. No. 12/654,630.

U.S. Appl. No. 12/654,630, filed Dec. 28, 2009, Jin-kwon Chun, Samsung Electronics Co., Ltd.

* cited by examiner

IMAGE FORMING APPARATUS HAVING VARIABLE DEVELOPER INTERVALS

CROSS-REFERENCE TO RELATED APPLICATIONS

This application is a divisional of U.S. application Ser. No. 12/654,630, filed on Dec. 28, 2009, which claims the benefit of Korean Patent Application No. 10-2009-0078850, filed on Aug. 25, 2009, in the Korean Intellectual Property Office, the disclosures of which are incorporated herein in their entirety by reference.

BACKGROUND

1. Field

Embodiments relate to an image forming apparatus, and more particularly, to an image forming apparatus having an improved optical path for forming an electrostatic latent image.

2. Description of the Related Art

An electro-photographic image forming apparatus, e.g., a laser printer or a copier, forms an electrostatic latent image on a surface of a photo conductor of a developer via an optical scanner, develops the electrostatic latent image into a color image by coating the electrostatic latent image with a developing agent such as a toner, and prints the image on a printing medium. In other words, when an optical scanner scans light onto a surface of the photo conductor charged to a predetermined electric potential, an electrostatic latent image is formed on the photo conductor as the electric potential of the scanner portion relatively drops, and an image is developed as toner particles are electrically attached to the electrostatic latent image. Furthermore, an image forming apparatus for forming color images include developers for four colors, yellow (Y), magenta (M), cyan (C), and black (K), and forms color images via combinations thereof.

Meanwhile, light emitted by a light source of the optical scanner travels through various optical components, such as lenses and mirrors, and reaches a surface of a photo conductor in each developer. A focusing distance from the light source to the surface of the photo conductor is appropriately set according to the type of the optical scanner. For example, a focusing distance of 100 mm can be accurately set between the light source and the surface of the photo conductor, and thus a clear electrostatic latent image may be obtained. Thus, when a plurality of optical scanners corresponding to the plurality of developers is used, the same type of optical scanners with the same focusing distance may be used for easy maintenance of components and later focusing distance adjustment. If different types of optical scanners with different focusing distances are used, maintenance of the optical scanners is difficult because each of the optical scanners have different adjusting conditions and different sensitivities.

In addition, since black (K) color is frequently used, black (K) color is used up the fastest. Thus, demands for increased capacity of a black (K) developer have increased. However, if the size of the black (K) developer is simply increased, the position of a photo conductor disposed therein is also changed, and thus a focusing distance set for developers of other colors does not match that of the black (K) developer. However, considering the maintenance difficulty, it is not preferable to use an optical scanner of a different type of which focusing distance is set with respect to the black (K) developer.

Therefore, it is necessary to increase the capacity of a color developer while using the same type of optical scanners.

SUMMARY

An embodiment provides an image forming apparatus of which light paths are improved, such that the capacities of color developers are improved while using the same type of optical scanners.

According to an aspect of the embodiment, there is provided an image forming apparatus including a plurality of developers; and optical scanners, each of the optical scanners including a light source and a light reflecting unit and forming an electrostatic latent image on a photo conductor of each of the developers, wherein the optical scanners have the same focusing distance from the light source to the photo conductor, and the light reflecting unit of one of the optical scanners is arranged at a position different from the light reflecting unit of another optical scanner, such that intervals between the developers vary.

Additional aspects and/or advantages will be set forth in part in the description which follows and, in part, will be apparent from the description, or may be learned by practice of the invention.

Here, the plurality of developers may include a yellow (Y) developer, a magenta (M) developer, a cyan (C) developer, and a black (K) developer, and the optical scanners may include a first optical scanner, which forms electrostatic latent images on two of the developers including the black (K) developer, and a second optical scanner, which forms electrostatic latent images on the other two developers.

Each of the light reflecting units of the first and second optical scanners may include a polygonal mirror unit, which rotates and reflects light emitted by the light source in a direction corresponding to a main scanning direction of the photo conductor, and a reflection mirror, which reflects light reflected by the polygonal mirror unit toward a surface of the photo conductor, and the first and second optical scanners may be arranged at different heights such that the reflection point of the polygonal mirror unit of the first optical scanner is closer to a corresponding photo conductor than the reflection point of the polygonal mirror unit of the second optical scanner.

Furthermore, each of the light reflecting units of the first and second optical scanners may include a polygonal mirror unit, which rotates and reflects light emitted by the light source in a direction corresponding to a main scanning direction of the photo conductor, and a reflection mirror, which reflects light reflected by the polygonal mirror unit toward a surface of the photo conductor, and the first and second optical scanners may be arranged such that the rotating axis of the polygonal mirror unit of the first optical scanner and the rotating axis of the polygonal mirror unit of the second optical scanner are not parallel to each other.

Furthermore, each of the light reflecting units of the first and second optical scanners may include a polygonal mirror unit, which rotates and reflects light emitted by the light source in a direction corresponding to a main scanning direction of the photo conductor, and a reflection mirror, which reflects light reflected by the polygonal mirror unit toward a surface of the photo conductor, and the first and second optical scanners may be arranged such that the optical axis between the reflection mirror of the first optical scanner and the photo conductor of the black (K) developer and the optical axis between the reflection mirror of the second optical scanner and the photo conductor of the corresponding developer are not parallel to each other.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Figure 1:
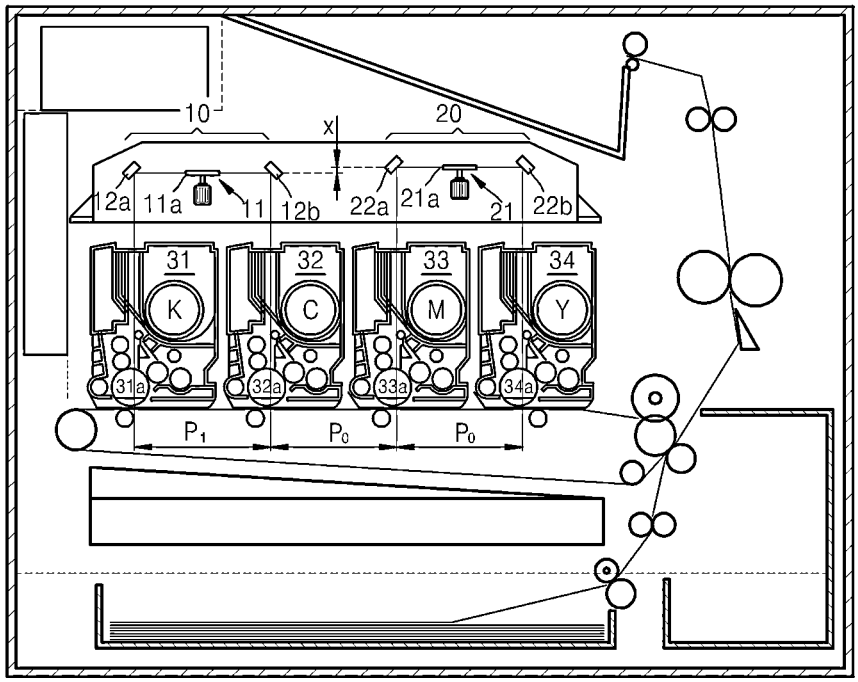
FIG. 1 is a diagram showing the internal structure of an image forming apparatus according to an embodiment.

Reference will now be made in detail to the embodiments, examples of which are illustrated in the accompanying drawings, wherein like reference numerals refer to the like elements throughout.

FIG. 1 is a diagram showing the internal structure of an image forming apparatus according to an embodiment. The image forming apparatus of FIG. 1 includes four developers 31, 32, 33, and 34 for four colors, i.e., yellow (Y), magenta (M), cyan (C), and black (K), and optical scanners 10 and 20, which form electrostatic latent images on photo conductors 31*a*, 32*a*, 33*a*, and 34*a* of the developers 31, 32, 33, and 34, respectively. Although a structure in which one optical scanner is disposed with respect to each developer has been used before, recent image forming apparatuses employ a simpler structure in which each of two optical scanners forms electrostatic latent images with respect to two of four developers. In other words, the first optical scanner 10 forms electrostatic latent images on photo conductors 31*a* and 32*a* of black (K) and cyan (C) developers 31 and 32, whereas the second optical scanner 20 forms electrostatic latent images on photo conductors 33*a* and 34*a* of magenta (M) and yellow (Y) developers 33 and 34. The first and second optical scanners 10 and 20 are of the same and have the same focusing distance.

Figure 2:
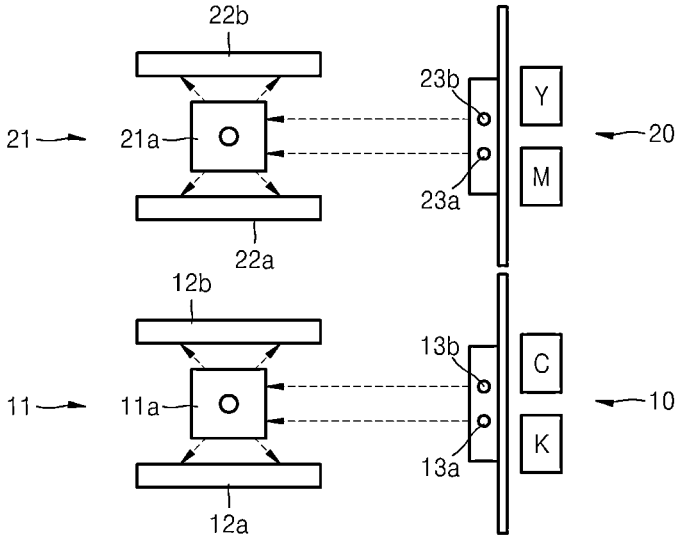
FIG. 2 is a plan view of an optical scanner in the image forming apparatus shown in FIG. 1.

As shown in FIGS. 1 and 2, the first and second optical scanner 10 and 20 respectively includes polygonal mirror units 11 and 21, which reflect lights emitted by light sources 13*a*, 13*b*, 23*a*, and 23*b* in the main scanning direction of the photo conductors 31*a*, 32*a*, 33*a*, and 34*a*, the main scanning direction corresponding to the widthwise direction of a printing medium (not shown), and reflection mirrors 12*a*, 12*b*, 22*a*, and 22*b*, which reflect lights reflected by the polygonal mirror units 11 and 21 toward surfaces of the photo conductors 31*a*, 32*a*, 33*a*, and 34*a*. In other words, when lights are emitted by the light sources 13*a*, 13*b*, 23*a*, and 23*b*, which respectively correspond to the developers 31, 32, 33, and 34, polygonal mirrors 11*a* and 21*a* of the polygonal mirror units 11 and 21 rotate and reflect the lights in a direction corresponding to the main scanning direction of the photo conductors 31*a*, 32*a*, 33*a*, and 34*a*, and the reflection mirrors 12*a*, 12*b*, 22*a*, and 22*b* reflect the reflected lights toward the photo conductors 31*a*, 32*a*, 33*a*, and 34*a*, so that electrostatic latent images are formed on surfaces of the photo conductors 31*a*, 32*a*, 33*a*, and 34*a*. Although optical components, e.g., a f-θ lens, may further be disposed on light paths of the optical scanners 10 and 20, only the polygonal mirror units 11 and 21 and the reflection mirrors 12*a*, 12*b*, 22*a*, and 22*b* are shown in the present embodiment for convenience of explanation.

Considering the positions at which the first and second optical scanners 10 and 20 are installed, the first optical scanner 10 is located to be closer to the corresponding photo conductors 31*a* and 32*a* and at a lower level than the second optical scanner 20. The arrangement is effective when an interval P1 between the black (K) developer 31 and the cyan (C) developer 32, which is close to the black (K) developer 31, is wider than intervals P0 between other developers. In other words, if the first optical scanner 10 is located to be at a lower level than the second optical scanner 20 as much as a distance X, the interval P1 is wider than the interval P0 as much as a distance 2X. If the focusing distance of the first and second optical scanners 10 and 20 is, for example, 100 mm and the first optical scanner 10 is vertically relocated to be closer to the photo conductors 31*a* and 32*a* by as much as 1 mm, the distance between the reflection mirrors 12*a* and 12*b* of the first optical scanner 10 and surfaces of the photo conductors 31*a* and 32 is decreased by 1 mm, and thus the distance between the polygonal mirror unit 11 and the reflection mirrors 12*a* and 12*b* should be increased by as much as 1 mm for obtaining a precise focusing distance. Since the first optical scanner 10 emits light in a horizontal direction toward the black (K) developer 31 and the cyan (C) developer 32, when the distance between the polygonal mirror unit 11 and each of the reflection mirrors 12*a* and 12*b* is increased by as much as 1 mm, the interval between the black (K) developer 31 and the cyan (C) developer 32 is increased twice as much, that is, by as much as 2 mm. Therefore, the interval between the black (K) developer 31 and the cyan (C) developer 32 twice as much as a height difference may be obtained, and thus the size of the black (K) developer 31 may be increased by as much as the increased interval. In other words, the capacity of the black (K) developer 31 may be easily increased while the optical scanners 10 and 20 of the same type are used.

Figure 3:
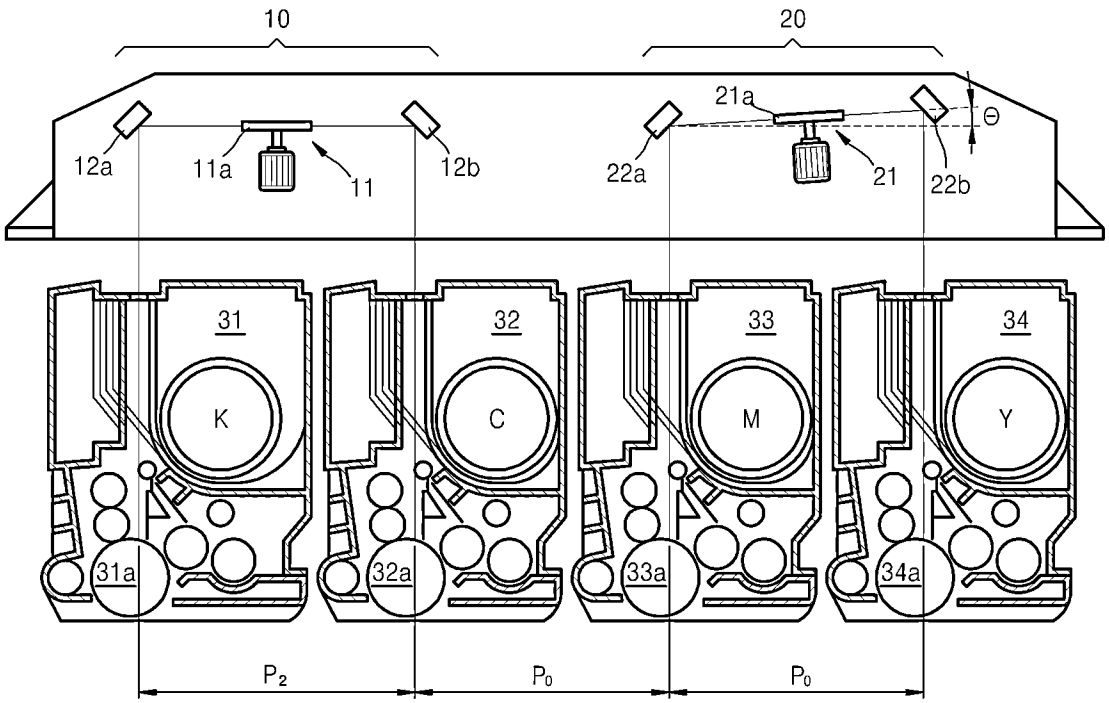
FIG. 3 is a diagram showing the internal structure of an image forming apparatus according to another embodiment.

Next, FIG. 3 is a diagram showing the internal structure of an image forming apparatus according to another embodiment. The image forming apparatus of FIG. 3 includes color developers 31, 32, 33, and 34 and optical scanners 10 and 20.

In the present embodiment, the rotating axis of a polygonal mirror unit 21 of the optical scanner 20 is tilted by θ, such that an interval P2 between the black (K) developer 31 and the cyan (C) developer 32, which is close to the black (K) developer 31, is wider than the intervals P0 between other developers. Accordingly, the interval P2 becomes wider than the interval P0 by as much as $(\sin\theta+1)/\cos\theta$, while the first and second optical scanners 10 and 20 maintain the same focusing distance. The relationship may be expressed as: $P2=P0+(\sin\theta+1)/\cos\theta$. In other words, the vertical distance between the reflection mirror 22*b* of the yellow (Y) developer 34 and the photo conductor 34*a* increases as the rotating axis of the polygonal mirror unit 21 of the second optical scanner 20 is tilted by θ, and thus the horizontal distance between the polygonal mirror unit 21 and the reflection mirror 22*b* of the yellow (Y) developer 34 may be reduced accordingly. Therefore, since the interval P0 is relatively reduced, the interval P2 relatively increases when the rotating axis of the polygonal mirror unit 11 of the first optical scanner 10 is arranged at a vertical position, and thus the capacity of the black (K) developer 31 may be increased as compared to other developers.

Figure 4:
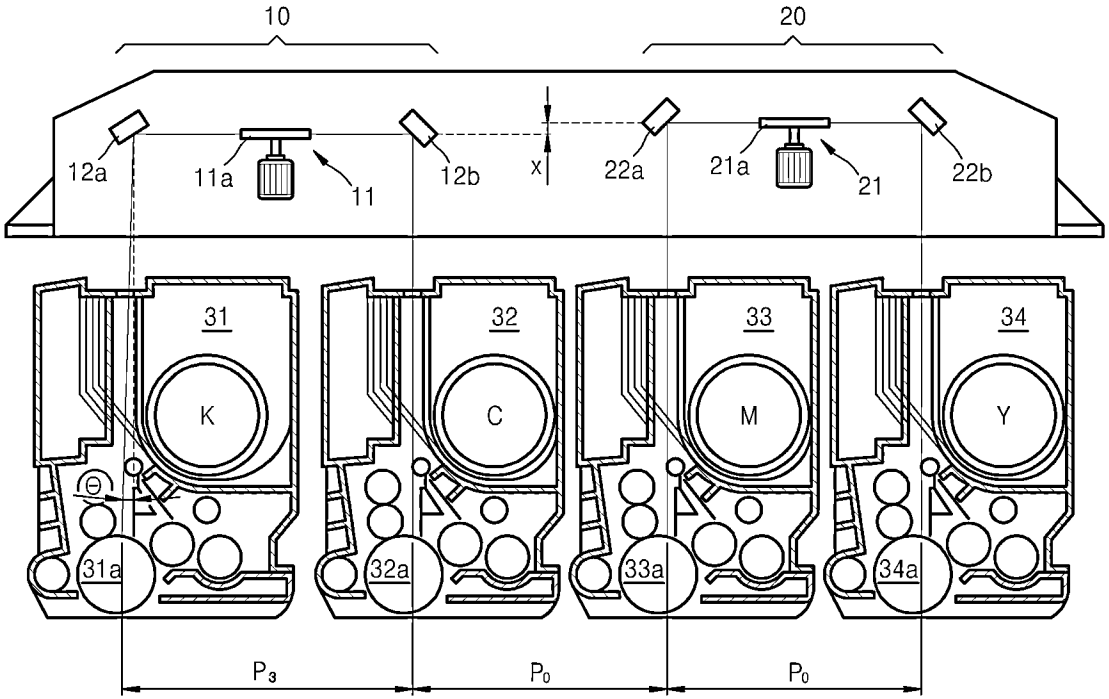
FIG. 4 is a diagram showing the internal structure of an image forming apparatus according to another embodiment.

FIG. 4 is a diagram showing the internal structure of an image forming apparatus according to another embodiment. The image forming apparatus of FIG. 4 includes color developers 31, 32, 33, and 34 and first and second optical scanners 10 and 20.

In the present embodiment, the positions of polygonal mirror units 11 and 21 of the first and second optical scanners 10 and 20 are vertically different by as much as a distance X as shown in FIG. 1, and, at the same time, the optical axis between the reflection mirror 12*a* of the black (K) developer 31 and the photo conductor 31*a* is further tilted by θ as compared to optical axis of the other developers 32, 33, and 34, such that an interval P3 between the black (K) developer 31 and the cyan (C) developer 32, which is close to the black (K) developer 31, is wider than the intervals P0 between other developers. As a result, the interval P3 becomes wider than the interval P0 as much as $(2X\cdot\sin\theta)/(1-\cos\theta)$. The relationship may be expressed as: $P3=P0+(2X\cdot\sin\theta)/(1-\cos\theta)$. In other words, the horizontal interval between the black (K) developer 31 and the cyan (C) developer 32 may be additionally secured by as much as 2X by arranging the polygonal mirror units 11 and 21 to be vertically apart from each other by as much as the distance X as shown in FIG. 1, and, at the same time, the horizontal interval may be further increased by tilting the optical axis of the black (K) developer 31 by θ. As a result, the capacity of the black (K) developer 31 may be increased by as much as the increased interval P3.

According to the embodiments described above, although developers of the same type are used, the capacity of the black developer, which is most frequently used, may be easily increased by arranging the relative positions of the developers.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a plurality of developers comprising a yellow (Y) developer, a magenta (M) developer, a cyan (C) developer, and a black (K) developer; and optical scanners comprising a first optical scanner, which forms electrostatic latent images on photoconductors of two of the developers including the black (K) developer, and a second optical scanner, which forms electrostatic latent images on photoconductors of the other two developers, each of the first and second optical scanners comprising a single light source and a light reflecting unit and forming an electrostatic latent image on a photo conductor of each of the developers, wherein the optical scanners have the same focusing distance from the light source to the photo conductor, and each of the light reflecting units of the first and second optical scanners comprise a polygonal mirror unit, which rotates and reflects light emitted by the light source in a direction corresponding to a main scanning direction of the photo conductor; and a reflection mirror, which reflects light reflected by the polygonal mirror unit toward a surface of the photo conductor, and the first and second optical scanners are arranged such that the optical axis between the reflection mirror of the first optical scanner and the photo conductor of the black (K) developer and the optical axis between the reflection mirror of the second optical scanner and the photo conductor of the corresponding developer are not parallel to each other, and the rotation axis of the polygonal mirror unit of the first optical scanner and the rotation axis of the polygonal mirror unit of the second optical scanner are parallel to each other, to vary intervals between the adjacent developers.

2. The image forming apparatus of claim 1, wherein the first and second optical scanners are arranged at different heights such that the reflection point of the polygonal mirror unit of the first optical scanner is closer to a corresponding photo conductor than the reflection point of the polygonal mirror unit of the second optical scanner.

* * * * *

UNITED STATES PATENT AND TRADEMARK OFFICE

CERTIFICATE OF CORRECTION

PATENT NO. : 8,854,409 B2
APPLICATION NO. : 13/669956
DATED : October 7, 2014
INVENTOR(S) : Jin-kwon Chun et al.

It is certified that error appears in the above-identified patent and that said Letters Patent is hereby corrected as shown below:

In the Claims

Column 6, line 5, in claim 1, before “light source” delete “single”.

Signed and Sealed this
Nineteenth Day of May, 2015

Michelle K. Lee

Michelle K. Lee
*Director of the United States Patent and Trademark Office*